United States Patent [19]

Dignal

[11] Patent Number: 4,982,061

[45] Date of Patent: Jan. 1, 1991

[54] ELECTRIC SWITCH

[75] Inventor: Fritz Dignal, Rietheim-Weilheim, Fed. Rep. of Germany

[73] Assignee: Marquardt GmbH, Rietheim-Weilheim, Fed. Rep. of Germany

[21] Appl. No.: 334,540

[22] Filed: Apr. 7, 1989

[30] Foreign Application Priority Data

Apr. 21, 1988 [DE] Fed. Rep. of Germany ..... 3813350

[51] Int. Cl.[5] ..... H01H 19/06; H01H 9/00

[52] U.S. Cl. ..... 200/302.3; 200/315; 200/438; 200/293

[58] Field of Search ..... 200/315, 302.3, 553, 200/339, 438, 293, 302.1, 310, 313

[56] References Cited

U.S. PATENT DOCUMENTS

| | | | |
|---|---|---|---|
| 3,742,171 | 6/1973 | Howe | 200/553 |
| 3,821,533 | 6/1974 | Bailey | 200/315 |
| 3,996,431 | 12/1976 | Brown | 200/293 |
| 4,013,857 | 3/1977 | Tanaka | 200/315 |
| 4,064,380 | 12/1977 | Mathews | 200/315 |
| 4,101,749 | 6/1978 | Josemans et al. | 200/315 |
| 4,104,981 | 8/1978 | Ono et al. | 200/316 |
| 4,121,071 | 10/1978 | Campbell et al. | 200/339 |
| 4,191,873 | 3/1980 | Woodward | 200/315 |
| 4,242,551 | 12/1980 | Sorenson | 200/315 |
| 4,268,734 | 5/1981 | Sorenson | 200/315 |
| 4,340,791 | 7/1982 | Sorenson | 200/315 |
| 4,440,991 | 4/1984 | Sorenson | 200/302.1 |
| 4,772,768 | 9/1988 | Nukada | 200/339 |
| 4,843,364 | 6/1989 | Place et al. | 200/284 |
| 4,874,911 | 10/1989 | Parrish | 200/284 |

*Primary Examiner*—Henry J. Recla
*Assistant Examiner*—Keith Kupferschmid
*Attorney, Agent, or Firm*—Spencer & Frank

[57] ABSTRACT

An electric switch, preferably with means of illumination, is of liquid-protected design and includes parts which can largely be assembled automatically. A switch housing (2) is substantially closed in the upper region and is provided with a bottom opening (11) in the lower region. A switching pin (5) of an operating element (6) passes through a small upper opening (4) into the housing and operates a contact bridge (18). The contact bridge (18) selectively connects a middle plug terminal (12) electrically with an outer plug terminal (25). An illumination unit (30) may be integrated into corresponding recesses in the housing. All parts can be fitted in a straight line into the housing through the corresponding openings (11, 4) during automatic assembly.

12 Claims, 1 Drawing Sheet

ELECTRIC SWITCH

BACKGROUND OF THE INVENTION

The invention relates to an electric switch, and more particularly to a switch which includes an operating element for actuating the switch, a switch housing for receiving at least two plug terminals led from the housing interior to the outside, the switch housing being of liquid-tight or liquid-protected design in its upper region, a contact bridge arranged in the housing interior, and possibly a means of illumination.

Electric switches, for example for the operation of coffee makers, are to be liquid-tight or substantially liquid-protected and able to be illuminated. In order that liquid cannot readily penetrate into the switch, known switches are, if appropriate, produced with a tight housing or with an additional rubber seal on the operator. Such known switches are, however, of a complicated design and are not suitable in particular for automatic assembly.

SUMMARY OF THE INVENTION

The object of the invention is to provide a substantially liquid-protected switch which is of simple design and is suitable in particular for automatic assembly.

Starting from an electric switch of the type designated at the beginning, this object is achieved by providing a switch housing which is closed in the upper region apart from a narrow opening for the leading through of a switch pin of the operating element, the switch housing being open downwards and having on the inside longitudinal grooves or the like which are directed from the bottom to the top in the housing wall and which receive the contact bridge and plug terminals designed as a contact system.

In the case of the switch according to the invention it is of significance that it is first of all as liquid-tight as possible, or at least covered in a liquid-protected manner, upwardly, i.e. in the direction of the operating element. In the case of the switch according to the invention this takes places by virtue of the fact that the switch housing is made virtually closed upwardly and leaves only a small opening for the leading through of the operating push rod for the contact bridge.

Downwardly the switch housing is of a completely open design, special measures being taken which allow the individual parts to be adapted for automatic assembly. In the event that liquid can nevertheless get into the inside of the switch through the upper push rod opening due to careless handling by the user, this liquid can quickly and easily leave the switch through the large bottom opening. Moreover, a large bottom opening in the switch housing offers the possibility of introducing the individual parts to be arranged in the interior of the switch by an automatic assembly operation, since only a straight loading is envisaged. Longitudinal grooves, receiving slots, channels or the like are provided for this, which serve to receive the contact system or a possible illumination unit with terminals.

The switch housing is advantageously of rectangular or square design, the operating element being designed as a rocker. A rectangular shape of the housing for example makes it possible to construct a very spacesaving switch. For this purpose, in the simplest case, two plug terminals are employed for a switch without illumination and three plug terminals arranged adjacent to one another in the switch housing are employed for a switch with illumination.

In order to achieve as good a protection as possible against liquid penetration in the upper region of the switch housing without the switch housing being closed completely at the top, a drawn-up collar is used on the housing upper part, which collar protrudes far into the rocker of the operating element and thus partitions of the switch interior from the outside. The drawn-up collar may at the same time have lateral bearing pins for the rocker bearing.

It is advantageous furthermore that the plug terminals are designed as a contact system. For this purpose, the middle plug terminal has a ridge bearing for the contact bridge, which bearing at the same time forms the electric contact connection. The outer plug terminal is bent off at right angles in order to form the counter contact surface for the contact bridge.

The inner housing wall and/or the plug terminals have projections or resilient lugs, for the mutual engagement upon introduction of the plug terminals into the housing interior.

Whenever the switch is provided with an illumination unit, the latter is embedded in a separate bore—in the case of use of a glow lamp—the series resistor is likewise arranged in a separate bore. Towards the top, the switch housing is made very thin in the region of this lamp socket, so that the light can shine through virtually without any loss if the housing material is transparent. The rocker bears a window in this region for the light to pass through.

The cable terminals of the illumination unit are made by means of notches on the plug terminals, the notches being compressed once the terminal wires have been inserted. It is furthermore advantageous to design the contact bridge with limbs arranged in the shape of a U. The lower longer limb serves to connect the middle plug terminal to the outer plug terminal. The upper limb serves as an operating surface for the switching pin of the rocker.

In order to save space, the contact spring is cut out in the form of a semi-circle in its outer region facing the glow lamp, so that the components can move more closely together in this region.

BRIEF DESCRIPTION OF THE DRAWINGS

In the figures, FIGS. 1 and 4 represent a side view in cut-open form, FIGS. 2 and 5 represent the respective front view of FIGS. 1 and 4 and FIGS. 3 and 6 represent a view from below through the bottom opening of the switch housing.

DESCRIPTION OF THE PREFERRED EMBODIMENTS

Figure 1:
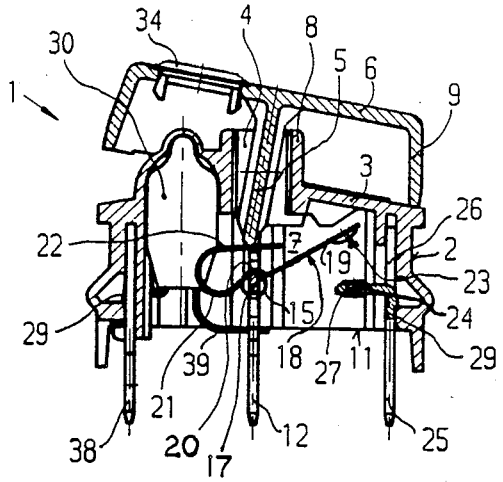
FIGS. 1 to 3 show a first exemplary embodiment with a built-in illumination unit.
Figure 4:
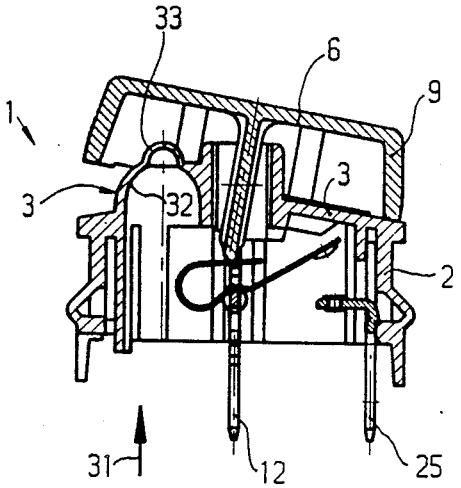
FIGS. 4 to 6 show the same switch system without an illumination unit.

The electric switch 1 represented in FIGS. 1 and 4 in side view is designed as a rocker switch, preferably for a coffee maker. The rocker switch has a housing 2, which is closed all around at the sides and the housing wall of which continues upward and forms an upper housing termination 3. Only in the middle region of the rectangular housing 2 is there provided in the upper housing termination 3 a through-opening 4, through which a switching pin 5 of the rocker-shaped operating element 6 protrudes into the housing interior 7. Around this through-opening 4, the upper housing termination or the housing upper part 3 is designed in the form of a drawn-up collar 8, which protrudes as far as possible into the pot-shaped housing 9 of the operating element 6 in order to achieve as comprehensive a sealing as possible of the through-opening 4 with respect to the housing interior 7.

The drawn-up collar 8 has laterally projecting protuberances 10, which serve as bearing pins for the operating element 6.

Figure 3:
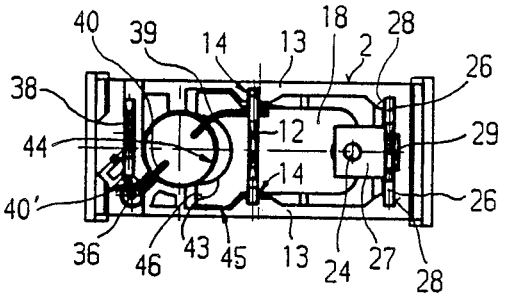
Figure 6:
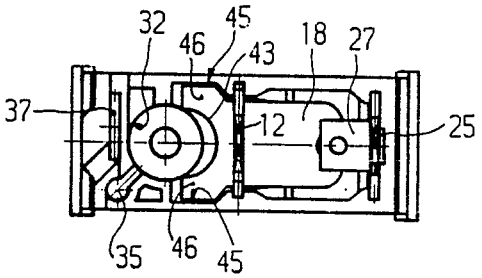

The housing 2 of the switch is completely open in its lower region by a bottom opening 11. FIGS. 3 and 6 show a view into this bottom opening from below.

In the middle region of the switch housing 2, a first, middle plug terminal 12 is fitted into the housing 2. For this, the lateral housing wall 13 has longitudinal grooves 14 or receiving slots or channels which are directed from bottom to top, i.e. in the vertical direction, into which the flat plug terminal 12 is pushed with its side edges. The housing wall 13 contains at the side a bore 15, into which a lateral projection of the plug terminal clips in order that the plug terminal and the wall mutually engage.

In the upper region, the plug terminal 12 is designed in the shape of a U, the lower horizontal cross piece between the U-shaped limbs being designed as a pointed or V-shaped ridge 17, which serves as bearing of the spring-like contact bridge 18 and at the same time as electric connection between the plug terminal 12 and the contact bridge 18. The contact bridge 18 has a lower longer limb 19, a V-shaped bend 20, a U-shaped bow 21 and an upper shorter limb 22. The V-shaped bend 20 serves as counter bearing with respect to the V-shaped ridge 17 of the plug terminal 12. At the end of the lower limb 19 there is provided an electric contact 23, which interacts with a contact 24 of a second, outer plug terminal 25. This outer plug terminal 25 likewise consists of a flat material, with a tongue 27 which is bent round between two U-shaped limbs 26 and bears the electric contact 24. The side edges of the outer plug terminal 25 in turn run in lateral longitudinal grooves 28 in the housing wall 13. A rearward nose or a projection 29 on the plug terminal 25 serves for the positive securing of the plug terminal 25 with respect to the housing 2 with a corresponding recess.

The switching pin 5 interacts with its lower end with the upper, shorter limb 22 of the contact bridge 18 in the sense of a switch change-over. In FIG. 1, the switching contact between the contacts 23, 24 is open, i.e. the lower limb 19 is lifted off from the contact 24 and inclined slightly upward. If the operating element 6 is pushed downward in the other direction, the contact bridge 18 snaps over, so that the contacts 23, 24 lie together and the lower arm 19 is approximately in a horizontal position.

Figure 2:
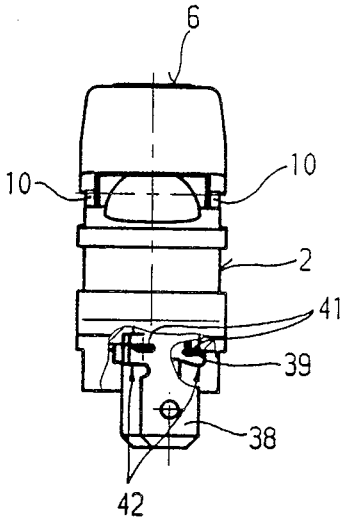
Figure 5:
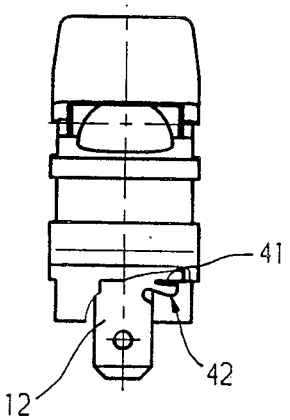

In FIGS. 1 to 3, the electric switch 1 additionally has a means of illumination 30 in the form of a glow lamp. The embodiment without means of illumination, i.e. without glow lamp, is represented in FIGS. 4 to 6, the housing design being envisaged for receiving such a means of illumination. The housing design for receiving a means of illumination 30 can therefore also be described with reference to FIGS. 4 to 6. As represented from FIG. 4 in the side view and FIG. 6 in the bottom view (viewing arrow 31), the interior of the housing 2 has an upwardly arcuate recess 32, which already has the shape of the glow lamp 30.

In the upper region of the housing termination 3, the housing material 33 is transparent, so that the light of the glow lamp 30 can pass through virtually without loss. In the case of the embodiment with an illumination unit, the operating element 6 bears a transparent window 34 (see FIG. 1), so that the light of the glow lamp 30 can likewise shine through upward. In the case of an embodiment without a glow lamp, the window 34 may dispensed with, as represented in FIG. 4.

Apart from the recess 32, matching the shape of the glow lamp 30, the housing 2 has a further longitudinal recess 35, in which the series resistor 36 of the glow lamp 30 is fitted. Finally, a further, slot-shaped longitudinal recess 37 is provided, into which the third plug terminal 38 is fitted in the case where an illumination unit 30 is provided. As already in the case of the plug terminals 12, 25, projections or resilient lugs 29 also serve in the case of the plug terminal 38 for mutual engagement with the housing.

If the electric switch is provided with a means of illumination, in particular a glow lamp 30 (FIGS. 1 to 3), the first terminal wire 39 is fastened to the middle plug terminal 12 and the second terminal wire 40 is firstly fastened to the series resistor 36 and from there (wire 40') to the third plug terminal 38. As represented in FIG. 2, the middle plug terminal 12 and the third plug terminal 38 have notches 41, into which the terminal wires 39, 40' of the glow lamp and of the series resistor, respectively, are inserted. A compression of these notches 41 in the region of the arrows 42 has the effect of tamping the terminal wires 39, 40' non-positively and positively. The design of the plug terminal 12 in this respect is likewise evident from FIG. 5.

As can be seen from the bottom view in FIGS. 3 and 6, the contact bridge 18 has in the region of its U-shaped bow 21 a semicircular recess 43, which is intended to serve as clearance for the outer contour 44 of the glow lamp 30. As a result, the glow lamp 30 can move very close to the contact bridge 18, without impairing the freedom of movement of the contact bridge.

The lateral housing walls 13 of the housing 2 have, furthermore, longitudinal grooves 45 for the laterally projecting part 46 of the U-shaped bow 21 of the contact bridge 18. These longitudinal grooves 45 likewise serve for the lateral guidance of the contact bridge 18.

With the exception of the operating element 6, the assembly of the individual parts of the switch 1 is performed exclusively through the bottom opening 11. In this assembly, firstly the contact bridge 18 is inserted and fixed by means of the middle plug terminal 12, with the V-shaped ridge 17 engaging the V-shaped bend 20 as a counter bearing. Thereafter, the second plug terminal 25 is pushed in a straight line into the housing.

The one terminal wire 40 of the glow lamp 30 is already connected to the series resistor 36. After fitting these two parts into the recesses 32 and 35, respectively, the one terminal wire 39 of the glow lamp is inserted into the notch 41 of the middle plug terminal 12, while the wire end 40' of the series resistor 36 is inserted into the further notch 41 of the third plug terminal 38. The two notches are then compressed with a certain clamping force and thus the wires are fixed (arrow 42).

Finally, the operating element 6 is fitted on from above, the switching pin 5 passing through the through-opening 4 and operating the upper limb 22 of the contact bridge 18.

All of the assembly operations can in this case be carried out fully automatically, since what is involved is essentially linear fitting of the parts into the corresponding housing recesses.

The invention is not restricted to the exemplary embodiment represented and described. Rather, it also comprises more further developments and refinements performed by a person skilled in the art without inventiveness of their own.

I claim:

1. An electric switch, comprising:

a switch housing having a housing interior, the housing additionally having an upper region with a top side and a lower region with a bottom side that is open, the upper region of the housing being of liquid-protected design and being closed except for a narrow opening, the upper and lower regions of the housing including a housing wall which extends between the top and bottom sides and which has longitudinal grooves facing the housing interior, the longitudinal grooves being directed from the bottom side toward the top side;

an operating element movably mounted on the housing and having a switching pin which extends through the narrow opening in the upper region of the housing and moves with the operating element;

a pair of plug terminals which extend from the housing interior through the open bottom side of the housing, the plug terminals being received in the longitudinal grooves; and a contact bridge, in the housing interior, which is switchable by the operating element to selectively connect or disconnect the pair of plug terminals electrically, wherein the housing interior defines a continuous path from the narrow opening in the upper region of the housing to the open bottom side to promote drainage of any liquid that may enter the housing interior.

2. The switch of claim 1, wherein the housing is of rectangular or square design, wherein the operating element is rocker-shaped, and wherein the switching pin bears against the contact bridge.

3. The switch of claim 1, wherein the top side of the upper region of the housing has a drawn-up colar, the narrow opening extending through the collar, and wherein the collar or the housing wall has bearing pins or bearing grooves for pivotably mounting the operating element.

4. The switch of claim 1, wherein one of the pair of plug terminals is centrally positioned in the housing and has an upper portion with a V-shaped ridge, the V-shaped ridge forming a pivot bearing for the contact bridge and also electrically connecting the centrally positioned plug terminal to the contact bridge.

5. The switch of claim 1, further comprising a switching contact on the contact bridge, and wherein one of the pair of plug terminals is an outer plug terminal with a tongue which is bent at a substantially right angle to form a switching contact that is engageable with the switching contact on the contact bridge.

6. The switch of claim 1, further comprising an illumination unit, and wherein the housing further includes means for defining a recess within the housing for receiving the illumination unit, wherein the upper region of the housing has a light-transmissive portion above the recess, and wherein the operating element has a light-transmissive portion above the recess.

7. The switch of claim 6, wherein one of the pair of plug terminals is centrally positioned in the housing, wherein the illumination unit is a glow lamp with a first wire and a second wire which is connected to the plug terminal that is centrally positioned in the housing, wherein the housing further includes means for defining an additional recess, and further comprising an additional plug terminal mounted in the housing, and a resistor connected between the first wire of the glow lamp and the additional plug terminal, the resistor being disposed in the additional recess.

8. The switch of claim 1, further comprising retaining means adjacent the longitudinal grooves for retaining the plug terminals received therein, the retaining means including resilient projections and matching recesses.

9. An electric switch comprising:

a switch housing having a housing interior, the housing additionally having an upper region with a top side and a lower region with a bottom side that is open, the upper region of the housing being of liquid-protected design and being closed except for a narrow opening, the upper and lower regions of the housing including a housing wall which extends between the top and bottom sides and which has longitudinal grooves facing the housing interior, the longitudinal grooves being directed from the bottom side toward the top side;

an operating element movably mounted on the housing and having a switching pin which extends through the narrow opening in the upper region of the housing and moves with the operating element;

first and second plug terminals which extend from the housing interior through the open bottom side of the housing, the second plug terminal being centrally positioned in the housing, the plug terminals being received in the longitudinal grooves;

a contact bridge, in the housing interior, which is switchable by the operating element to selectively connect or disconnect the first and second plug terminals electrically;

a glow lamp with a first wire and a second wire, the second wire being electrically connected to the second plug terminal;

a third plug terminal mounted in the housing; and a resistor connected between the first wire of the glow lamp and the third plug terminal, the resistor having a wire, wherein the housing further includes means for defining a recess within the housing for receiving the glow lamp, wherein the upper region of the housing has a light-transmissive portion above the recess, wherein the operating element has a light-transmissive portion above the recess, wherein the housing additionally includes means for defining an additional recess, the resistor being disposed in the additional recess, and wherein the second plug terminal has a notch which receives the second wire of the glow lamp and the third plug terminal has a notch which receives the wire of the resistor, the second plug terminal and the third plug terminal being compressed adjacent their respective notches after the wires have been received therein.

10. An electric switch, comprising:

a switch housing having a housing interior, the housing additionally having an upper region with a top side and a lower region with a bottom side that is open, the upper region of the housing being of liquid-protected design and being closed except for a narrow opening, the upper and lower regions of the housing including a housing wall which extends between the top and bottom sides and which has longitudinal grooves facing the housing interior, the longitudinal grooves being directed from the bottom side toward the top side;

an operating element movably mounted on the housing and having a switching pin which extends through the narrow opening in the upper region of the housing and moves with the operating element;

first and second plug terminals which extend from the housing interior through the open bottom side of the housing, the second plug terminal being a centrally positioned plug terminal and including a ridge, the plug terminals being received in the longitudinal grooves; and a contact bridge, in the housing interior, which is switchable by the operating element to selectively connect or disconnect the first and second plug terminals electrically, wherein the switch has a conductive state in which the first and second plug terminals are electrically connected, and wherein the contact bridge is generally U-shaped and has a lower limb and an upper limb, the upper limb being shorter than the lower limb and being engaged by the switching pin of the operating element, the contact bridge being pivotable on the ridge of the second plug terminal and being electrically connected to the second plug terminal by the ridge, the lower limb of the contact bridge being approximately horizontal in the conductive state of the switch to electrically connect the lower limb to the first plug terminal.

11. An electric switch, comprising:

a switch housing having a housing interior, the housing additionally having an upper region with a top side and a lower region with a bottom side that is open, the upper region of the housing being of liquid-protected design and being closed except for a narrow opening, the upper and lower regions of the housing including a housing wall which extends between the top and bottom sides and which has longitudinal grooves facing the housing interior, the longitudinal grooves being directed from the bottom side toward the top side;

an operating element movably mounted on the housing and having a switching pin which extends through the narrow opening in the upper region of the housing and moves with the operating element;

a pair of plug terminals which extend from the housing interior through the open bottom side of the housing, the plug terminals being received in the longitudinal grooves; and a contact bridge, in the housing interior, which is switchable by the operating element to selectively connect or disconnect the pair of plug terminals electrically, wherein the switch housing is a single, unitary member.

12. An electric switch, comprising:

a switch housing of rectangular or square design, the housing having a housing interior, the housing additionally having an upper region with a top side and a lower region with a bottom side that is open, the upper region of the housing being of liquid-protected design and being closed except for a narrow opening, the upper and lower regions of the housing including a housing wall which extends between the top and bottom sides and which has longitudinal grooves facing the housing interior, the longitudinal grooves being directed from the bottom side toward the top side;

an illumination unit mounted in the housing interior;

a rocker-shaped operating element movably mounted on the housing and having a switching pin which extends through the narrow opening in the upper region of the housing and moves with the operating element;

a pair of plug terminals which extend from the housing interior through the open bottom side of the housing, the plug terminals being received in the longitudinal grooves; and a contact bridge, in the housing interior, which is switchable by the operating element to selectively connect or disconnect the pair of plug terminals electrically, the switching pin of the operating element bearing against the contact bridge, the contact bridge having a bent-around, U-shaped region with a recess into which a portion of the illumination unit extends, the recess being semicircular in plan view.

* * * * *